US005431427A

United States Patent [19]

Pieber et al.

[11] Patent Number: 5,431,427

[45] Date of Patent: Jul. 11, 1995

[54] SKI HAVING A BINDING MOUNTING PLATE FITTED ABOVE THE SKI BODY, AT LEAST PARTLY AT A DISTANCE THEREFROM AND IN FIXED RELATIONSHIP THERETO

[75] Inventors: Alois Pieber; Johann Stroi, both of Reid, Austria

[73] Assignee: Fischer Gesellschaft m.b.H., Reid am Innkreis, Austria

[21] Appl. No.: 79,270

[22] Filed: Jun. 21, 1993

[30] Foreign Application Priority Data

Jul. 15, 1992 [AT] Austria ..... 1451/92

[51] Int. Cl.[6] ..... A63C 5/06

[52] U.S. Cl. ..... 280/607; 280/602

[58] Field of Search ..... 280/602, 607, 618, 620, 280/636

[56] References Cited

U.S. PATENT DOCUMENTS

| | | | |
|---|---|---|---|
| 3,260,532 | 7/1966 | Heuvel | 280/11.13 |
| 3,326,564 | 6/1967 | Heuvel | 280/602 |
| 3,797,844 | 3/1974 | Smolka et al. | 280/607 X |
| 4,294,460 | 10/1981 | Kirsch | 280/607 |
| 4,896,895 | 1/1990 | Bettosini | 280/607 |
| 5,167,424 | 12/1992 | Baggio et al. | 280/602 |
| 5,213,355 | 5/1993 | Juhasz | 280/602 |
| 5,251,923 | 10/1993 | Stepanek et al. | 280/602 |
| 5,269,555 | 12/1993 | Ruffinengo | 280/602 |
| 5,280,942 | 1/1994 | Ruffinengo | 280/602 |

FOREIGN PATENT DOCUMENTS

| | | | |
|---|---|---|---|
| 299030 | 6/1972 | Austria . | |
| 0182776 | 5/1986 | European Pat. Off. | 280/602 |
| 0188985 | 7/1986 | European Pat. Off. | 280/602 |
| 0469452 | 2/1992 | European Pat. Off. . | |
| 2259375 | 6/1974 | Germany | 280/602 |
| 2601951 | 7/1977 | Germany . | |
| 2902838 | 9/1979 | Germany | 280/636 |
| 9102551.6 | 5/1991 | Germany . | |
| 8303360 | 10/1983 | WIPO . | |
| 8801189 | 2/1988 | WIPO | 280/602 |

*Primary Examiner*—Brian L. Johnson

*Attorney, Agent, or Firm*—Jacobson, Price, Holman & Stern

[57] ABSTRACT

Ski, in particular downhill ski, comprising a binding mounting plate provided above the ski body and fixed thereto at least in part at a distance therefrom, wherein at least one guide means 5, 7, 8, 10 is provided which guides the binding mounting plate 2 in a plane normal to the surface of the ski body 1 and parallel to the longitudinal ski axis, and prevents twisting of the plate 2 or of regions thereof about an axis parallel to the longitudinal ski axis.

17 Claims, 4 Drawing Sheets

SKI HAVING A BINDING MOUNTING PLATE FITTED ABOVE THE SKI BODY, AT LEAST PARTLY AT A DISTANCE THEREFROM AND IN FIXED RELATIONSHIP THERETO

BACKGROUND OF THE INVENTION AND PRIOR ART

The invention relates to a ski, in particular a downhill ski, comprising a binding mounting plate fitted above the ski body, at least partly at a distance therefrom and in fixed relationship thereto.

Such constructions as described for example in AT-PS 299 030 have been proposed for the purpose of on the one hand maintaining a constant distance between the ski binding components in the event of any flexing of the ski which may arise and yet not increasing the rigidity of the ski or influencing its elasticity. However, with the conventional designs an exact steerability of the ski is not afforded because, due to possible elastic deformations of the binding mounting plate, the steering forces can be transmitted to the ski to a decreased degree or with a time delay only. The latter factor also applies to the construction according to U.S. Pat. No. 3,260,532, in which a binding mounting plate is connected to a ski in a manner pivotable about its longitudinal axis at its front and rear ends. In addition to this manner of connection of the binding mounting plate which disadvantageously affects the accurate steerability of the ski, the last mentioned patent specification also provides no indication regarding the problems of leaving the elasticity of the ski unaffected.

Likewise, a binding mounting plate is provided in connection with the vibration damping means according to EP-OS 469 452. However, the former is not firmly fixed to the ski body but is mounted thereon by way of yielding elements, so that pivoting of the plate in relation to the ski body about a longitudinal axis is possible. As a result, the accurate and undelayed steerability of the ski is not provided even though, as in the construction according to AT-PS 299 030 the distance of the ski binding parts remains unaltered during flexing of the ski. However, the comparatively rigid binding plate according to EP-OS 469 452 influences the flexing properties of the ski body, this influence increasing, as the hardness of the yielding elements between the plate and the ski body increase. On the other hand, as the hardness of the elements decreases, the pivotability of the plate increases and accordingly the ability of accurately transmitting control forces without delays decreases.

OBJECTS OF THE INVENTION

It is an object of the present invention to provide a construction by means of which on the one hand a far-reachingly harmonic elastic line of the ski is attainable without flexing being adversely affected by the forces originating from the binding, the accurate and delay-free transmission of control forces onto the ski being assured at the same time.

GENERAL DESCRIPTION OF THE INVENTION

In order to attain this object, starting from the construction described in the introduction it is proposed, according to the invention, that at least one guide means is provided which guides the binding mounting plate in a plane normal to the surface of the ski body and parallel to the longitudinal axis of the ski and prevents twisting of the plate or of parts thereof about an axis parallel to the longitudinal axis of the ski. These expedients permit a relative movement of the ends of the binding mounting plate in relation to the ski body in which both move relatively together or apart, a degree of change in the relative position of at least the ends of the plate in relation to the ski body being also possible in a direction parallel to the longitudinal ski axis. This permits a flexing of the ski body free from influences exercised by the binding mounting plate, such that the desired harmonic flexing pattern of the ski body for attaining the optimal running performance can be attained. However, at the same time, an internal distortion of the binding mounting plate as well as a lateral pivoting of the plate is prevented and in that manner it is assured that all steering forces applied by the skier are transmitted to the ski directly without delay and without being weakened. In particular an edge application of the ski is possible exactly to the desired extent and exactly at that instant at which the skier initiates the movement. A further advantage of the construction, according to the invention, resides in that due to the spring action of the binding mounting plate there even occurs a damping of impacts onto the foot of the skier, whereby in particular the joints are protected and running comfort is noticeably improved.

In order to further inhibit torsional movement of the binding mounting plate, it is possible to provide that one of said means each is provided at both ends of the binding mounting plate.

According to a further feature of the invention the binding mounting plate is rigidly connected to the ski body at one locality only. Preferably the connection of the plate is brought about to the upper web and the core of the ski, and by virtue of this firm and rigid connection even a relative pivotal movement between the plate and the ski body about a vertical axis is reliably prevented, so that an accurate turning control of the ski is likewise ensured.

Advantageously, the binding mounting plate is rigidly connected to the ski body between its ends, preferably in its central region. This results in two bending arms projecting forwardly and rearwardly from the fixation locality and which act particularly advantageously in the cushioning of impacts due to the inherent elastic properties of the binding mounting plate itself. Since in all binding types generally used nowadays, a gap is provided between the sole of the ski boot and the binding plate the aforesaid damping affect is present even in the event of central impacts in the region of the fixation locality of the binding mounting plate, because the applied impact is first absorbed by a flexing of the binding mounting plate without being directly transmitted to the ski boot.

It is possible to influence the elasticity properties of the binding mounting plate lengthwise if, according to an additional feature, the under-side of the binding mounting plate is embossed longitudinally and optionally also laterally, and in the alternative if the binding mounting plate comprises longitudinal sections, each of different but constant thickness, the largest thickness being provided in the central longitudinal section, or if a progressive merging is provided between a longitudinal section of maximum and constant thickness adjoined on both sides by longitudinal sections of minimum thickness, preferably at the ends of the binding mounting plate. In all of the aforesaid possibilities, it is also feasible, by means of accurate dimensioning to attain an affect on the flexing, particularly in the event of very strong flexing of the ski body by virtue of the upper-side of the ski body entering into contact with the under-side of the binding mounting plate.

In the case of the last mentioned embodiment of the binding mounting plate a modification which can be produced particularly simply is provided in that the transition is brought about by two longitudinal sections which extend along the under-side longitudinally at a slant angle.

In order to be able to adapt the construction according to the invention to skies of different design and accordingly different rigidity distributions and also different flexing patterns, a further feature of the invention provides that the length of the binding mounting plate corresponds to 75% to 120% of the ISO standard length of the binding fixation region, and the width of the binding mounting plate amounts to between 75% and 120% of the ski width in the binding fixation region. This accordingly permits an accurate adaptation of the length of the binding mounting plate to the actual ski length and ski properties.

A further possibility to influence both the shock absorption by way of the binding mounting plate as well as the flexing characteristics of the ski can be provided in that, in the interspace between the ski body and the binding mounting plate an elastic material, preferably a viscoelastic material is provided. Such material may even absorb a major portion of the impact energy due to its shock absorbing properties, and by appropriate selection of the hardness of the elastic material it is possible to achieve a predetermined influence on the flexing of the ski.

According to a further feature of the invention, each guide means comprises a component fitted to the ski body ahead of, respectively behind the binding mounting plate, and projecting above the surface of the latter in the direction of the plate and comprising each a rebate, for accommodating a member projecting from the plate forwardly respectively rearwardly, as the case may be, the height of the rebate being greater than the thickness of the member of the plate and the width of the rebate corresponding to the smallest width of the said member in a direction normal to the surface of the ski body. Due to this arrangement the ends of the binding mounting plate are irrotationally guided in the desired plane, whereas a flexing of the ski body is possible without hindrance since the ends of the binding mounting plate can move towards the ski body in the recesses. The term "smallest width of the aforesaid member" denotes that in the event of twisting of the binding mounting plate, that part of the plate which projects into the rebate of the component has a cross-sectional dimension which is larger in a direction normal to the surface of the ski body than would be the case in the unloaded position of rest when the plate is not twisted. A tab of rectangular cross-section may serve as an example herefore.

In order not to interfere with the flexing of the ski body, in particular during incipient flexing, a distance is provided between the component and the binding mounting plate at least when unloaded, in the direction parallel to the longitudinal ski axis.

A simple and functionally reliable construction results if the component is or comprises a strap having a rebate passing therethrough and the forwardly, respectively rearwardly projecting part of the binding mounting plate is a tab of essentially rectangular cross-section and slightly lesser width than that of the plate itself, and projects into the rebate. The smaller the difference between the width of the tab and the inner diameter of the rebate in the strap, the better will be the prevention of twisting and turning of the plate and the better will be the effect of the construction according to the invention with regard to accuracy of transmission of steering forces.

In the last described construction, in order to prevent twisting of the binding mounting plate, the width of the rebate is preferably less than the diagonal dimension of the cross-section of the forwardly and rearwardly projecting part of the binding mounting plate.

In order to avoid an abrupt transition between the upper-side of the ski body and the binding mounting plate and, where the space between the plate and the upper-side of the ski body is empty, to avoid the entrance of snow, respectively other foreign bodies from the front, the component according to a further feature of the invention is a cap which rises substantially wedge-shaped towards the binding mounting plate and comprises a rebate for a tab of the binding mounting plate having a substantially rectangular cross-section. This also results in an attractive visual appearance of the ski which, due to the last mentioned feature, in addition to lending itself for decorative purposes, also provides aerodynamic advantages.

As an alternative to the above described embodiment, each guide means may also comprise a component fixed to the ski body and projecting above the surface thereof in the direction of the binding mounting plate, being each laterally embraced by two parts projecting from the plate forwardly and rearwardly, the inner-sides of the part preferably hugging the outsides of the components. Due to the relatively large thickness of the forwardly and rearwardly projecting part, a twisting of the ends of the binding mounting plate is limited by contact against the upper or lower inner margins, such twisting being even prevented entirely in the embodiment referred to above as being preferred. A movement of the ends of the binding mounting plate towards the ski body and away therefrom nevertheless remains possible so that the unimpeded flexing of the ski body is not resisted. As a result, in this embodiment as well, the harmonious flexing characteristic with simultaneous accurate steerability of the ski is provided for.

Advantageously a distance is provided between the component and the foremost and rearmost edge of the binding mounting plate between the forwardly rearwardly projecting part, at least in the unloaded condition in the direction parallel to the longitudinal ski axis. This distance takes care of an unimpeded ability of the ski body to flex at least at the commencement of flexing.

With both of the last described constructions it is possible, according to a further feature of the invention, for the component to comprise a region above the upper-side of the binding mounting plate and which, in order to improve the twisting-respectively torsion-preventing effect will, in the unloaded state, bear onto the upper-side of the binding mounting plate.

According to a further alternative embodiment of the invention, provision is made that each means comprises at least one rod-shaped component extending through the terminal region of the binding mounting plate, being fixed to the ski body and in normal orientation to the surface of the ski body, extending through an elongate aperture in the plate having a longitudinal axis of the ski, and the dimension of which in that direction is greater than the diameter of the component in that direction and the dimension of which normal to that direction preferably equals the corresponding diameter of the component. Once again the elongate aperture provides a guide for the ends of the binding mounting plate in the direction towards the ski body or away therefrom, as well as in the direction of the longitudinal ski axis, whilst twisting of the binding mounting plate is prevented in that the plate has a similar thickness and the upper and lower edges of the elongate aperture comes to bear against the rod-shaped component. In the event that the inner periphery of the elongate aperture bears against the component even in the unloaded condition, a twisting of the binding mounting plate is prevented entirely so that in that event once again the maximum accuracy of steerability combined with a complete prevention of torsional deformation of the plate results. Flexing of the ski body is in no event interfered with.

Advantageously the rod-shaped component terminates above the upper-side of the binding mounting plate and is provided with an element or portion protruding above this upperside. Due to this construction, as in the case of the components having portions bearing onto the upperside of the binding mounting plate, a limitation of the pivoting of the ends of the binding mounting plate away from the ski is provided for, so that excessive bending loads on the binding mounting plate and possible fracturing or loosening of the plate from the ski upperside will be avoided. At the same time these protruding elements and portions assist in preventing twisting of the plate in the unloaded or slightly loaded state.

An embodiment, the manufacture of which is particularly simple and low-cost, results if the rod-shaped component is a screw anchored in the ski body, optionally comprising a protruding head.

An improved guidance and more stable arrangement is provided according to a further feature of the invention if at each end of the binding mounting plate two rod-shaped components and elongate apertures are provided side by side in relation to the longitudinal ski axis.

In the last mentioned embodiment as well, it is possible with the same advantages as stated above, to provide ahead of and optionally, also behind the binding mounting plate, a cap which rises essentially in wedge form in relation to the plate, and which in the unloaded state terminates preferably at the same level as the upperside of the plate, a gap being left between the cap and the plate. This gap serves to permit free flexing of the ski prior to the cap entering into contact with the ends of the plate, thereby inhibiting further flexing.

In order to avoid material entering into the gap and interfering with the function, it is possible for the gap to be filled with an elastic material. The properties of such material can be so selected that changes in distance between the cap and the plate are resisted to a negligible extent so that flexing of the ski is not inhibited.

In the following description the invention is to be further explained with reference to the accompanying drawings by way of non-limiting working examples.

BRIEF DESCRIPTION OF THE DRAWINGS

In this context

DETAILED DESCRIPTION OF SPECIFIC EMBODIMENTS

Figure 1A:
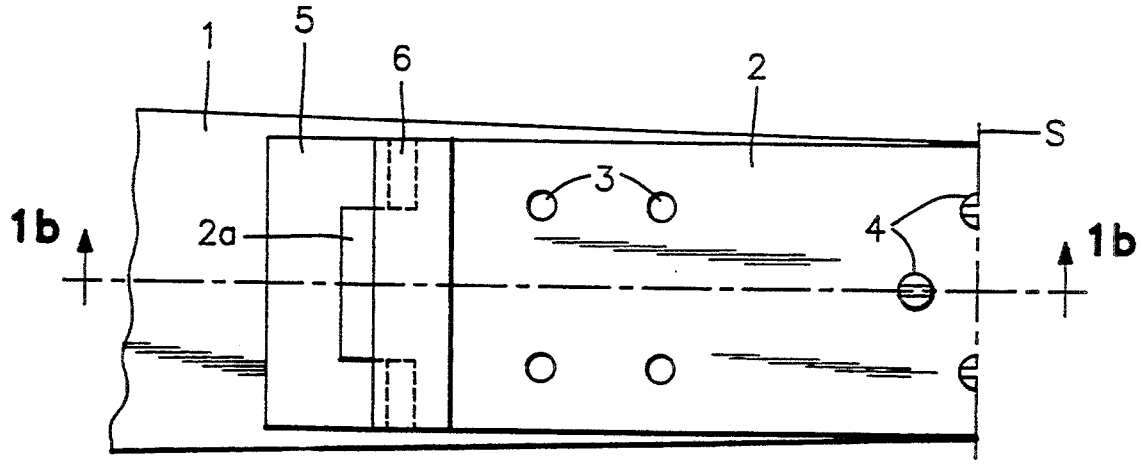
FIGS. 1*a* to *c* illustrate a first working example of the subject of the invention, FIG. 1*a* representing a plan view, FIG. 1*b* a section along the line b—b of FIG. 1*a* and FIG. 1*c* a section along the line c—c of FIG. 1*b*.

The following description is to be read against the background of the preceding general description of the invention. FIG. 1*a* shows a plan view onto a ski according to the invention in its binding fixing region. On a ski body 1 of optional design a binding mounting plate 2 is rigidly fixed between its ends, preferably in the central region, being provided with bores 3 for accommodating the binding fixing screws. In the illustrated example the binding mounting plate 2 is rigidly fitted to the ski body 1 by means of four screws 4. The rigid connection might, however, also be brought about by adhesive action, welding, or other suitable connecting methods.

In order to avoid twisting of the free ends of the binding mounting plate 2 and to guide its ends in one plane only, which is parallel to the longitudinal ski axis and normal to the surface of the ski body 1, guide means are provided preferably at both ends of the plate 2 which, in the illustrated example, are represented by essentially Z-shaped components 5. These components 5 are connected to the upper-side of the ski body 1 ahead of and behind the binding mounting plate in an optional manner, i.e. by adhesion, screwing etc. In principle it is also conceivable for the ski body 1 to be constructed integrally in one part with the binding component 5 so that the latter represents a portion of the ski body 1.

The above referred to guidance of the plate 2 is brought about in that a preferably rectangular tab 2*a* projecting forwardly and rearwardly engages into a rebate 5*a* of a section 5*b* of the component 5 projecting upwardly towards the plate 2 from the surface of the ski body 1 and is guided irrotationally in such rebate 5*a*. Preferably, the inner width of the rebate 5*a* corresponds to the width of the tab 2*a*.

In the example illustrated the component 5 in addition comprises a section 5*c* which, at least in the non-loaded state of the binding mounting plate 2 when the ski body 1 is not flexed, bears against the upper-side of the plate 2. In doing so the section 5*c* assists in avoiding twisting of the binding mounting plate 2 and also acts as a stop member to prevent excessive upward flexing and possible damage of the plate 2.

Even though this is not illustrated in the drawing, it should be noted that by the insertion of spacer elements into the recess 5*a* of the upwardly projecting section 5*b*, a modification of the flexing characteristics of the ski body 1 can be attained in that a stop member for the tab 2*a* of the binding mounting plate 2 can be provided having a variety of heights, i.e. for different degrees of flexing of the ski body 1. Likewise, it is possible to exercise an influence in that the interspace between the ski body 1 and the binding mounting plate 2 is at least partly filled with an elastic material (not shown), visco-elastic material being preferably employed. This, at the same time, serves to dampen shocks and can moreover prevent the entrance of foreign bodies such as snow, ice, etc. into the said interspaces, thereby to ensure unimpeded function. A prevention of the entrance of snow, etc. is also possible by a lateral and front coverage of the interspace, when the interspace between the ski body 1 and the plate 2 is kept free in other respects.

With the aforementioned advantages and an additional improvement of the visual appearance the front and rear guide means may also be covered by cap members.

Because in the event of flexing of the ski body 1 and essentially unchanged rectilinear binding mounting plate 2, not only the distance of the ends of the plate 2 from the ski body 1, but also their relative longitudinal positions are changed, a distance fixed between the component 5 and the front edge of the binding mounting plate 2 besides the tab 2*a* is provided in order not to interfere with such flexing by the aforesaid edge beating against the upwardly projecting section 5*b*, and thereby to permit free flexing of the ski body 1.

Figure 2A:
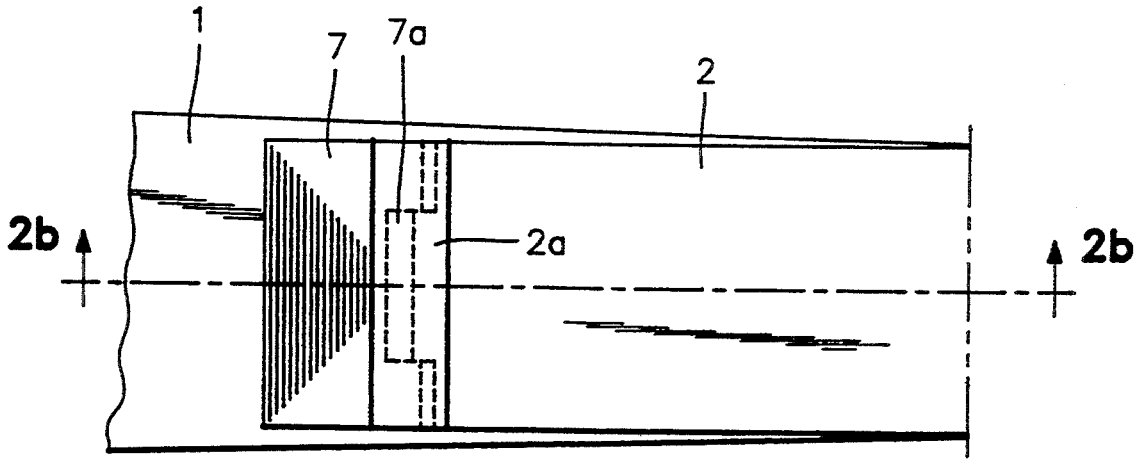
FIGS. 2*a* to *c*, FIGS. 3*a* to *c* and FIGS. 4*a* to *c* show further embodiments of the subject of the invention, the views and sections corresponding to those of FIGS. 1*a* to *c*.
Figure 2B:
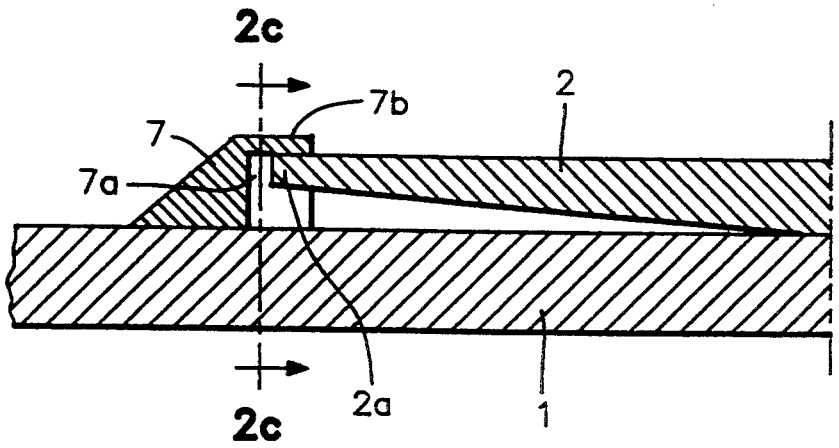
Figure 2C:
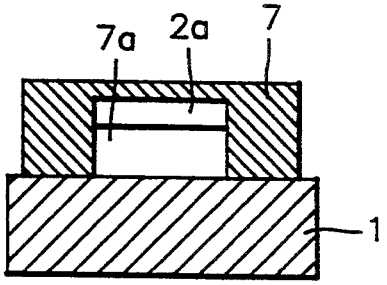

In FIGS. 2*a* to 2*c* a further embodiment of the invention is illustrated. In that case for purposes of simplicity of illustration, the bores for the binding fixation screws were omitted in the plan view according to FIG. 2*a*. The screws 4 for fitting the plate 2 onto the ski body 1 were omitted in order to indicate that the said plate 2 might also, for example, be bonded to the surface of the ski body 1 by adhesive action. Moreover, only a single guide means at one end of the plate 2 was illustrated in order to show that it is feasible to provide the aforesaid guide means only at one end of the plate 2, even though it is obviously more advantageous to guide both ends of the binding mounting plate 2 irrotationally.

Once again the guided ends of the binding mounting plate 2 comprises a forwardly projecting tab 2*a* of essentially rectangular cross-section. Instead of the Z-shaped component 5 a cap 7 has been provided in this case, which rises substantially in wedge shape towards the plate 2, and which provides a rebate 7*a* for the accommodation for the tab 2*a*. Once again the inner width of the rebate 7*a* preferably corresponds to the width of the tab 2*a*, and in order to ensure free flexing a distance has been provided between the front edge of the binding mounting plate 2, specifically of its tab 2*a*, and the rearmost limitation of the opposing surfaces of the cap 7.

Figure 1B:
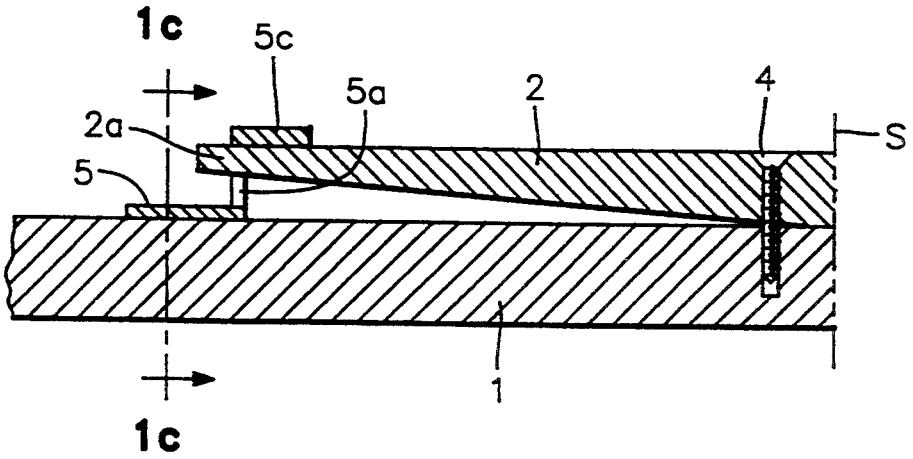
Figure 1C:
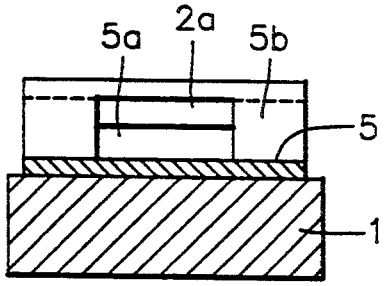

The cap 7 as well has been illustrated comprising a section 7*b* which bears onto the upper-side of the plate 2 and, apart from this, the modifications discussed in the context of FIG. 1 such as, for example the employment of a viscoelastic material (not shown) between the ski body 1 and the plate 2, are possible.

Figure 3A:
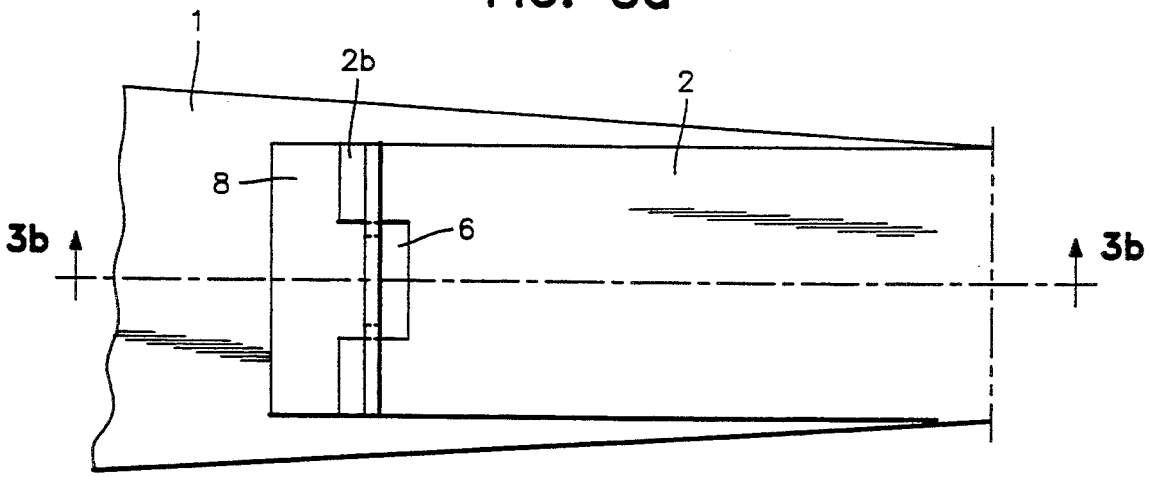
Figure 3B:
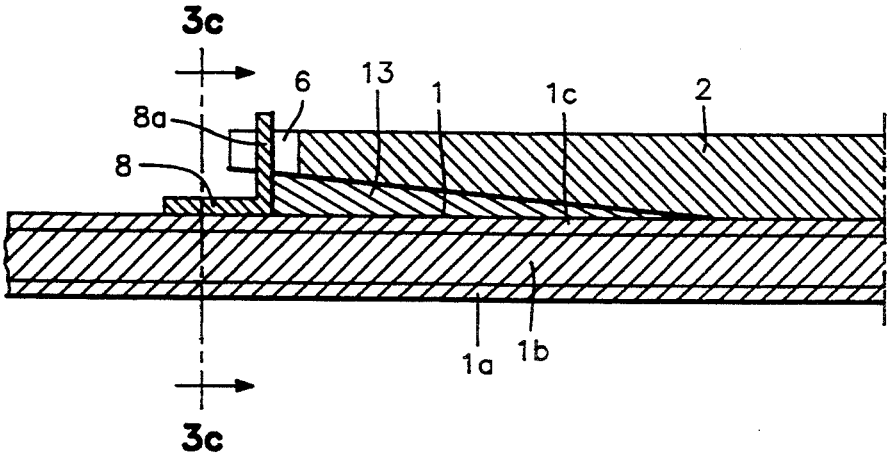
Figure 3C:
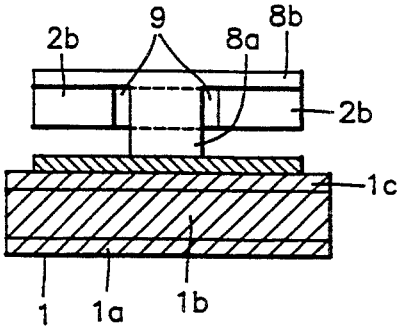

A further embodiment of the subject of the invention is illustrated in FIGS. 3*a* to *c*, wherein once again a component 8, upwardly projecting towards the binding mounting plate 2, is provided on the upper-side of the ski body 1. In order to indicate a particularly advantageous and nowadays preferred ski construction, the ski body 1 has been illustrated as being composed of a lower web 1*a*, a ski core 1*b* and an upper web 1*c*. The same construction can, of course, also be provided in the context of the binding mounting plate 2 in each of the various embodiments.

The component 8, which guides the ends of the plate 2, comprises a section 8*a* which projects upwardly from the upperside of the ski body 1 towards the plate 2, which is embraced by two members 2*b* forwardly projecting from the binding mounting plate 2. Again, in order to ensure the free flexing, a distance 6 is provided between the front edge of the plate 2 between the two forwardly projecting members 2*b* and the section 8*a* of the component 8. Moreover, as apparent from FIG. 3*c*, a gap 9 is also provided between the inner periphery of the part 2*b* and the lateral rim of the section 8*a*, thereby providing a degree of lateral tolerance. If twisting of the ends of the panel 2 were to exceed a predetermined degree, the inner periphery of the part 2*b* of the plate 2 would, however, come to bear against the outer edges of the section 8*a*, thereby preventing a further twisting of the plate 2.

At the upper end of the section 8*a* of the foremost component 8, a transversely protruding section 8*b* is provided which, in the unloaded and non-flexed state of the ski, once again bears onto the upperside of the plate 2.

It stands to reason that in this embodiment as well, each additional feature discussed in the context of the preceding modifications could be provided, e.g. by covering the guide means and the free space between the plate 2 and the ski body 1, by the insertion of an elastic material 13 into the interspace, etc. Likewise, in each of the previously described embodiments, or still to be referred to, that portion which bears onto the plate 2, can be omitted if, due to the strength of the material or similar expedients, no risk exists that the ends of the plate 2 might be deflected too far away from the ski, or the plate 2 might come loose from the ski body 1 in the event of excessive loading.

Figure 4A:
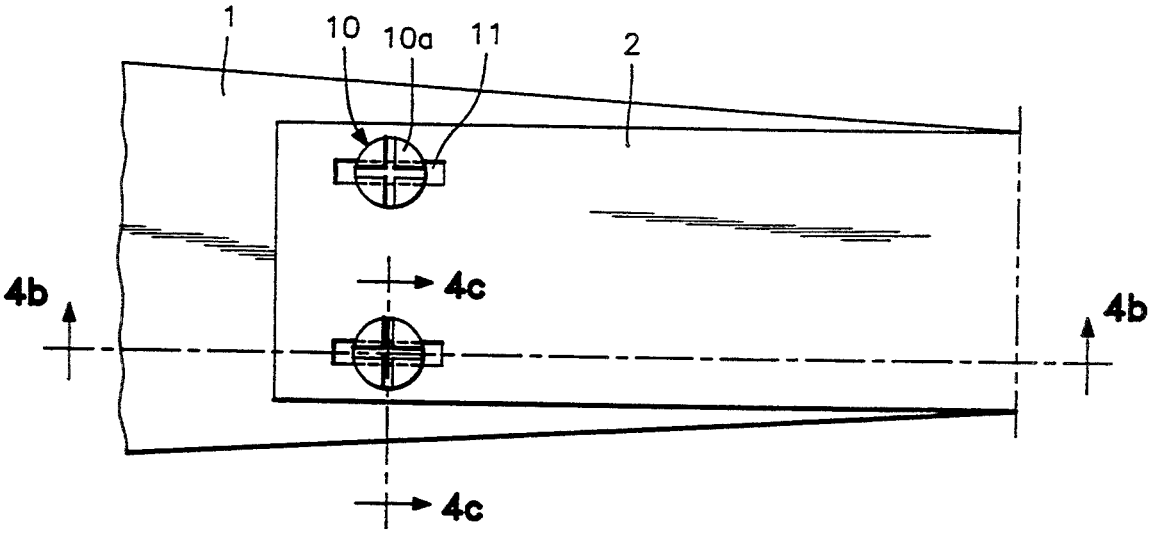
Figure 4B:
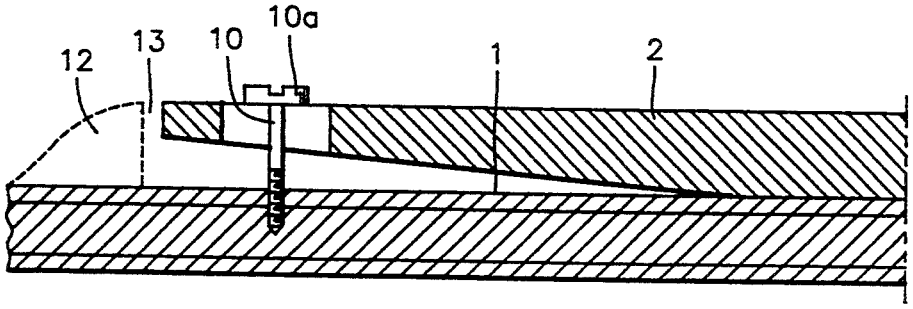
Figure 4C:
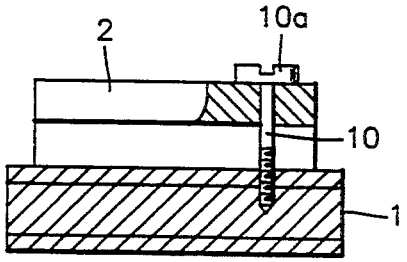

A further advantageous and relatively simply produced modification of the subject of the invention is illustrated in FIGS. 4*a* to *c*. In that case, the guidance of the ends of the plate 2 is brought about by two rod-shaped components, preferably screws 10 at each end of the plate 2. These screws 10 extend through elongate apertures 11 in the terminal regions of the plate 2 and are anchored in the ski body 1. In this case the elongate apertures 11 are so arranged that their major dimension is parallel to the longitudinal ski axis, so that a relative longitudinal displacement between the ski body 1 and thus the screws 10 fixed therein, and the ends of the plate 2, is possible.

By the use of screws 10 having laterally protruding elements or formations or heads 10*a*, a limitation of the flexing of the ends of the plate 2 in an upwards direction is brought about in a simple manner. On the other hand, it is obviously also possible to employ rod-shaped components for guiding the ends of the plate 2 which, over the entire length, have a constant diameter.

As illustrated in FIG. 4*b*, a cap member 12 is provided ahead of and behind the binding mounting plate 2 which rises essentially wedge-shaped to the binding mounting plate 2, a gap being left between the cap member 12 and the plate 2. The cap member 12, in the unloaded state, terminates at the same level as the upperside of the plate 2. The cap member 12 may be used in conjunction with each of the previously illustrated and discussed embodiments although it is not illustrated in FIGS. 1*a* to *c*, FIGS. 2*a* to *c* or FIGS. 3*a* to *c*.

The claims which follow are to be considered an integral part of the present disclosure. Reference numbers (directed to the drawings) shown in the claims serve to facilitate the correlation of integers of the claims with illustrated features of the preferred embodiment(s), but are not intended to restrict in any way the language of the claims to what is shown in the drawings, unless the contrary is clearly apparent from the context.

We claim:

1. Ski, comprising a ski body, a binding mounting plate above an upper surface of said ski body and connected rigidly and longitudinally fixed to said ski body at a position between the two longitudinal ends of said binding mounting plate and with an under side of said binding mounting plate at least in part at a distance above the upper surface of said ski body, and two guide means mounted to the ski body adjacent to one of the ends of said binding mounting plate for guiding the respective end of the binding mounting plate in a plane normal to the surface of the ski body and parallel to the longitudinal ski axis.

2. Ski as claimed in claim 1, comprising an elastic material inserted between the ski body and the binding mounting plate.

3. Ski as claimed in claim 2, wherein the elastic material inserted between the ski body and the binding mounting plate is viscoelastic.

4. Ski as claimed in claim 1, wherein the binding mounting plate is rigidly connected to the ski body in the central region of said binding mounting plate.

5. Ski as claimed in claim 1, wherein a positive lock is provided between the guide means and the binding mounting plate.

6. Ski as claimed in claim 1, wherein the under side of the binding mounting plate is longitudinally embossed, whereby the ends of the binding mounting plate are directed upwardly.

7. Ski as claimed in claim 1, wherein the under side of the binding mounting plate is laterally embossed.

8. Ski as claimed in claim 1, wherein one of said guide means is fitted in front of the binding mounting plate and the other guide means is fitted behind the binding mounting plate to the ski body, both guide means projecting above an upper surface of said ski body in the direction of the binding mounting plate and each comprising a rebate for accommodating a part projecting from the binding mounting plate, the height of the rebate being greater than the thickness of said part and the width of the rebate corresponding to the smallest width of said part normal to the upper surface of the ski body.

9. Ski as claimed in claim 1, wherein each of said guide means is a strap including said rebate passing therethrough and each of said parts projecting from the binding mounting plate is formed by a tab having a substantially rectangular cross-section, smaller width than the binding mounting plate itself and projects into said rebate of the adjacent guide means.

10. Ski as claimed in claim 1, wherein each of said guide means comprises at least one component fixed to the ski body and projecting upwardly above the upper surface of said ski body in the direction of the binding mounting plate and each of said guide means is laterally embraced by at least two parts, respectively, projecting from the binding mounting plate.

11. Ski as claimed in claim 10, wherein the inner surfaces of the parts projecting from the binding mounting plate hug the outer surface of an upwardly projecting section of the component forming the guide means.

12. Ski as claimed in claim 1, wherein in the foremost and the rear terminal region of the binding mounting plate at least one elongate aperture is provided, the longitudinal axis of said aperture being parallel to the longitudinal axis of the ski body, and wherein each of said guide means comprises at least one rod-shaped component projecting upwardly above the upper surface of said ski body in the direction of the binding mounting plate and passing through one of said apertures, the dimension of the longitudinal aperture in the direction parallel to the axis of the ski body being larger than the diameter of the rod-shaped component in the same direction.

13. Ski as claimed in claim 12, wherein the dimension of the aperture in the end of the binding mounting plate normal to the longitudinal axis of the ski body is at least equal to the diameter of the rod-shaped component in the same direction.

14. Ski as claimed in claim 13, wherein the dimension of the aperture in the end of the binding mounting plate normal to the longitudinal axis of the ski body is greater than the diameter of the rod-shaped component in the same direction.

15. Ski as claimed in claim 6, wherein the rod-shaped component terminates above the upper surface of the binding mounting plate and comprises elements or formations protruding parallel to and above said upper surface of the binding mounting plate.

16. Ski as claimed in claim 1, wherein ahead of and behind the binding mounting plate a cap member is provided, which cap member rises wed-shaped to the binding mounting plate and comprises a rebate for accommodating a part projecting from the binding mounting plate, the height of the rebate being greater than the thickness of said part and the width of the rebate corresponding to the smallest width of said part normal to the upper surface of the ski body, a gap being left between the cap member and the binding mount plate.

17. Ski as claimed in claim 16, wherein the cap member, in unloaded state of the ski body and the binding mounting plate, terminates at the same height above the upper surface of the ski body as the upper surface of the binding mounting plate.

* * * * *